United States Patent [19]

Schaefer

[11] 4,173,047

[45] Nov. 6, 1979

[54] TUBULAR BORDER FRAME FOR INNER SPRING ASSEMBLIES

[75] Inventor: John W. Schaefer, Des Plaines, Ill.

[73] Assignee: Nachman Corporation, Des Plaines, Ill.

[21] Appl. No.: 904,040

[22] Filed: May 8, 1978

[51] Int. Cl.[2] ..... A47C 23/04; A47C 25/00

[52] U.S. Cl. ..... 5/260; 5/267

[58] Field of Search ..... 5/260–262, 5/267

[56] References Cited

U.S. PATENT DOCUMENTS

| | | | |
|---|---|---|---|
| 2,052,040 | 8/1936 | Sklar | 5/260 |
| 2,078,396 | 4/1937 | MacEwan | 5/260 |
| 2,096,767 | 10/1937 | Sklar | 5/260 |
| 2,249,999 | 7/1941 | Asaro | 5/260 |
| 3,688,320 | 9/1972 | Hartley | 5/260 |

*Primary Examiner*—Casmir A. Nunberg

*Attorney, Agent, or Firm*—McDougall, Hersh & Scott

[57] ABSTRACT

A tubular border frame for inner spring assemblies is disclosed. The border frame includes an opening defined by a pair of inwardly directed lips adapted to receive and secure the coil springs. Straight and corner connectors are provided for joining the sections of the frame to form a complete border surrounding the springs.

15 Claims, 27 Drawing Figures

TUBULAR BORDER FRAME FOR INNER SPRING ASSEMBLIES

BACKGROUND OF THE INVENTION

This invention relates to the field of inner spring and box spring manufacture. More specifically, it relates to improvements in the hardware utilized for assembly of inner and foundation spring units to reduce the cost and assembly time thereof.

Inner spring mattresses are typically formed by positioning a large number of coil springs in an assembly jig and then securing the springs one to the other with helically formed wire. In a similar fashion helically formed wire is utilized to fasten a relatively heavy peripheral wire to the coil springs on the outer edges to prevent lateral movement.

The assembly steps required to apply helical formed wire around the springs and peripheral wire to form a border is costly and difficult. Often the assembly process must be stopped and re-started due to failure to properly position the wire applicator or due to jam-ups. Accordingly, it is desirable to simplify the assembly process by eliminating the helically formed wire and the peripheral wire border frame.

According to the present invention a tubular border frame is utilized which is provided with a central recess defined by a pair of inwardly directed lips which are adapted to receive the coil springs. By quick manual attachment of the coil springs to the border frame, assembly is completed without the problems encountered in the prior art.

It is accordingly an object of the present invention to provide an improved border frame assembly which is low in cost and provides improved assembly rates.

Another object of the invention is to provide a tubular border frame for inner springs and box springs which can be rapidly assembled and attached to the spring assemblies without the need for special tools or fasteners.

A further object of the present invention is to provide a tubular border frame employing connectors for joining the segments of the border frame to form the complete assembly.

A further object of the invention is to provide a means of securing coil springs to a box spring assembly by use of tubular sections adapted to receive said coil springs therein.

Other objects and advantages of the invention will be apparent from the remaining portion of the specification.

PRIOR ART STATEMENT

The closest prior art of which applicant is aware is the border frame assembly employing helically formed wire and peripheral wire or peripheral wire fastened by clips to coils around the edge of the assembly described in the background of this specification.

DETAILED DESCRIPTION

Figure 1:
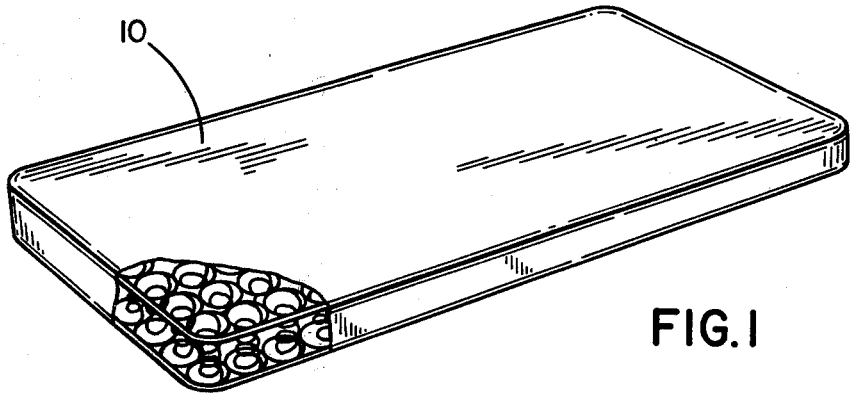
FIG. 1 is a perspective view of an inner spring mattress employing a border frame according to the invention.
Figure 2:
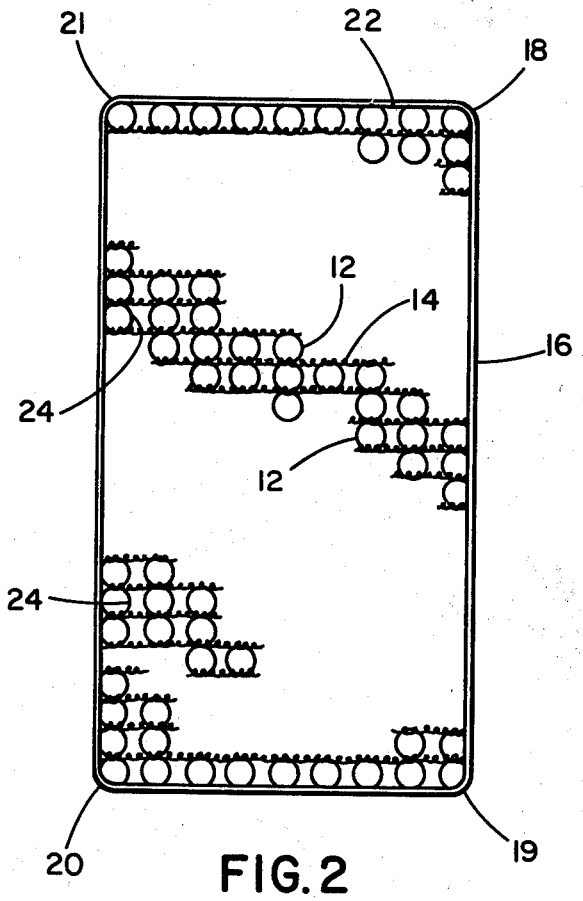
FIG. 2 is a plan view of an inner spring employing the border according to the present invention.

Referring now to FIGS. 1 and 2, there is illustrated an inner spring mattress 10. The inner spring design includes a plurality of coil springs 12. These springs have large coils at their top and bottom and taper in diameter from both ends towards the middle. The large top and bottom coils are joined together by the use of helically formed wire 14 which is threadingly secured around the large coils in a manner well known in the art. Thus, in order to assemble an inner spring mattress of the type illustrated in FIG. 1, a plurality of coil springs 12 are usually placed on an assembly jig (not illustrated) and then the helical wire 14 is utilized for securing the top and bottom of the springs into an integral unit.

In order to complete the assembly it is common practice in the prior art to join the outside springs to a peripheral wire to form a border frame around the spring assembly. This is accomplished in much the same manner that the interior springs are joined. That is, helical wire is utilized to conjunction with a peripheral wire to form the border frame surrounding the coil spring assembly and to secure the springs on the outer periphery one to the other. Application of helically formed wire together with a peripheral wire to form a border frame, as contrasted with merely joining the interior springs, is a significantly time consuming and more difficult assembly process.

According to the present invention helical and peripheral wire are completely eliminated with respect to forming a border frame and instead there is provided a tubular border frame which can be rapidly attached to the large coils without the need for any special training or equipment.

According to a first embodiment, the tubular border frame 16 is provided in one piece having 90° bends at 18, 19, 20 and 21. The one piece border frame is cut through at 22 to permit it to be placed around the spring assembly and then snapped onto the large coils 24 of each outside spring. The break at point 22 is secured together by means of a connector illustrated in FIGS. 10 and 11 to be described subsequently.

Referring to FIGS. 4 through 7, the tubular border frame is illustrated in greater detail. The frame 16 is tubular in cross section and is provided with a central opening defined by a pair of inwardly extending lips 30 and 32. The lips extend inwardly to a point of engagement near the center of the tube. If desired, the lips may be interrupted by notches 34 spaced along the length of the tube thereby to form locking tabs 36 from the lips 30 and 32.

During assembly of the border frame the large coil 24 of each spring is manually forced between the lips 30 and 32 of the tubular frame with sufficient pressure to slightly spread the lips and permit entry of the coil into the tubular interior. In the case where notches 34 are provided, as the coil 24 enters the tube one or more pairs of tabs 36 will swing free of the coil and move back to the initial position of engagement thereby to affirmatively lock the coil in the tubular frame.

In the case where notches are not provided the border frame lips remain separated by a distance approximating the diameter of the large coil 24 after insertion. Preferably the tubular border frame is formed of metal or other suitable materials having a sufficient resilience that the lips will grip the large coil 24 thereby to securely retain it within the border frame.

In either case it will be observed that the border frame may be quickly assembled by merely placing it around the spring assembly and then snapping the large coils into the tubular frame.

Figure 3:
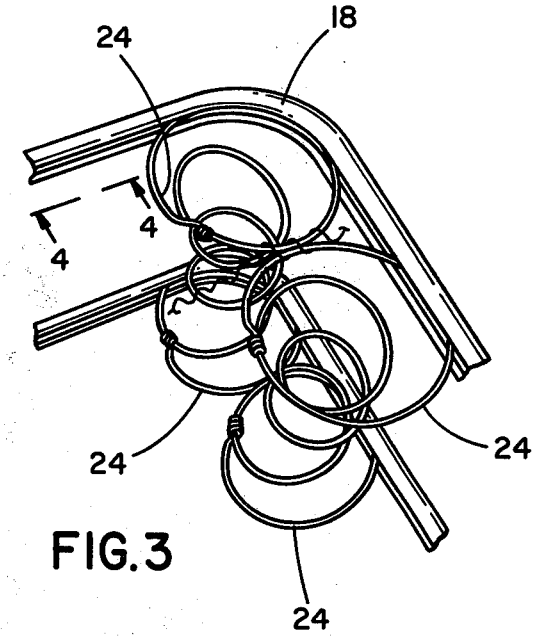
FIG. 3 illustrates a tubular border frame according to a first embodiment of the invention.
Figure 4:
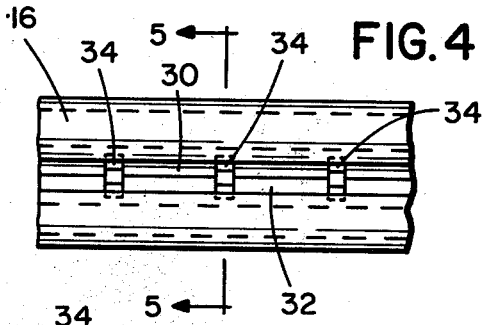
FIG. 4 is a view along the lines 4—4 of FIG. 3.

With reference to FIG. 3, it will be observed that at the corner 18 the tubular frame receives the large coil 24 in precisely the same manner as on the straight portions of the frame. Special bending techniques, well known in the art, maintain the tube channel of the frame at the proper spacing to receive the coil.

Figure 5:
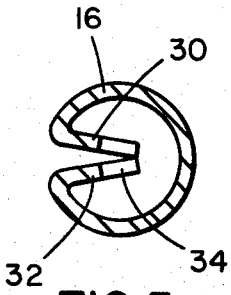
FIG. 5 is a view along the lines 5—5 of FIG. 4.
Figure 6:
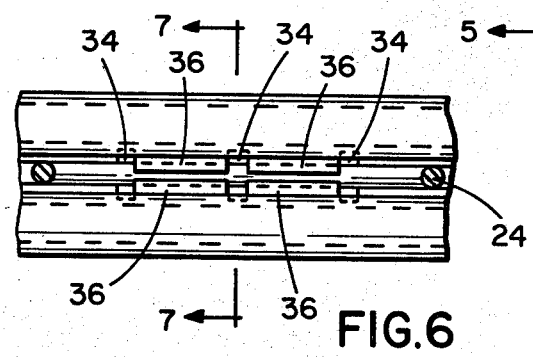
FIG. 6 is a view similar to FIG. 4 illustrating the manner in which a coil spring is locked into the tubular frame.
Figure 7:
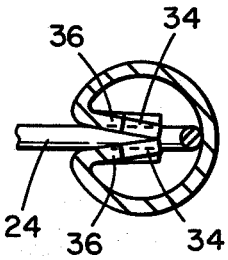
FIG. 7 is a sectional view along the lines 7—7 of FIG. 6.
Figure 8:
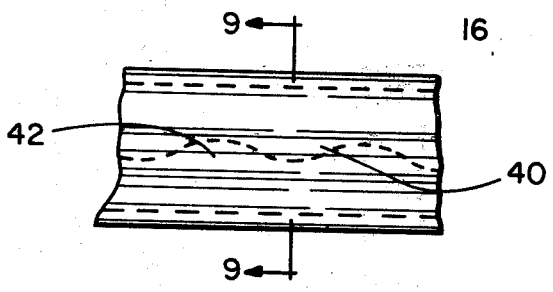
FIG. 8 is a view similar to FIG. 4 illustrating a tubular frame according to a second embodiment of the invention.
Figure 9:
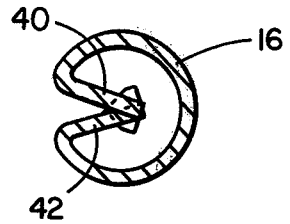
FIG. 9 is a cross sectional view along the lines 9—9 of FIG. 8.

An alternative construction for the border frame is illustrated in FIGS. 8 and 9. In this construction, as opposed to FIGS. 5–7, the tubular frame 16 is provided with a pair of lips 40 and 42, the ends of which are rippled or undulate in a manner similar to a sinusoidal waveform. The crest of one lip nests into the trough of the opposite lip. This construction enhances the gripping ability of the border frame to insure that the large coils will not slip out. While the slotted embodiment of FIG. 5 provides a positive locking mechanism the undulating embodiment of FIGS. 8 and 9 is somewhat less expensive to manufacture and may be preferable under certain circumstances.

Figure 10:
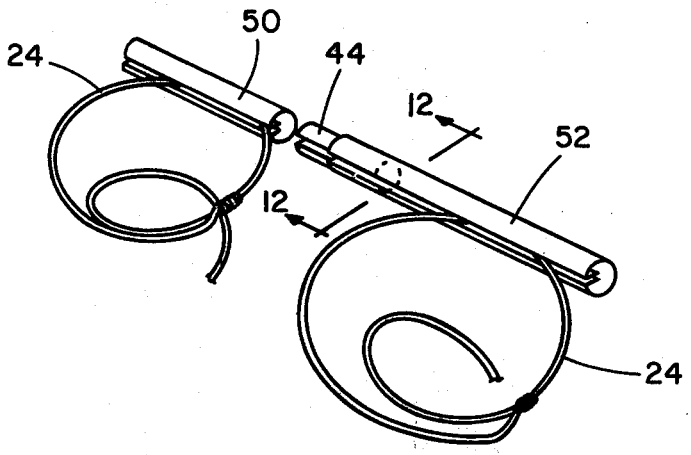
FIG. 10 is a perspective view illustrating the straight connector element joining a section of border frame.
Figure 11:
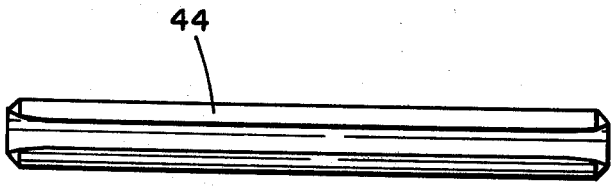
FIG. 11 is a side elevational view of a straight connector element.
Figure 12:
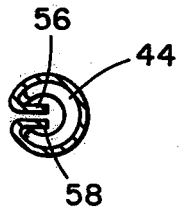
FIG. 12 is a sectional view along the lines 12—12 of FIG. 10 illustrating the manner in which the connector element is received in the tubular frame.

Referring now to FIGS. 10, 11 and 12, the connecting means for joining the border frame illustrated in FIG. 2 is shown. As stated in connection with FIG. 2, the border frame may be one piece having an opening at 22 to permit the frame to be placed around the spring assembly. Alternatively, the border frame may be separated into several pieces for ease of assembly and, for example, additional openings could be provided on each side and at the top and bottom of the border frame.

Regardless of the number of openings 22 the connecting means illustrated in FIGS. 10 through 12 is provided to join together two straight sections of border frame. The straight connecting element 44 may be formed of metal or plastic and is C-shaped in cross section, as illustrated in FIG. 12. The connecting means is adapted to have a portion thereof received within each of the two sections 50 and 52 which are to be joined. The connecting means is dimensioned to provide a press fit when inserted into the ends of the tubular frame.

An important point with respect to the straight connecting member 44 is that adequate clearance must be provided for the lips of the tubular frame to allow for their movement upon insertion of the spring coil 24 into the frame. As illustrated in FIGS. 11 and 12, the connecting member 44 is C-shaped in cross section and provides a large clearance so that the lips 56 and 58 may flex outwardly to receive the coil therein.

Assembly of the unit is accomplished by attaching each section of border frame to the coil springs and then attaching the border frame sections one to the other by use of the connecting means 44. It will be understood that during the assembly of the border frame it is possible to reverse these steps, as desired, whereby sections of border frame may be connected and then the coil springs snapped into the frame if desired by the assembler. The press fit of the connecting means is adequate under most circumstances to maintain the border frame intact since the frame is securely connected to the spring assembly at a plurality of points.

Figure 13:
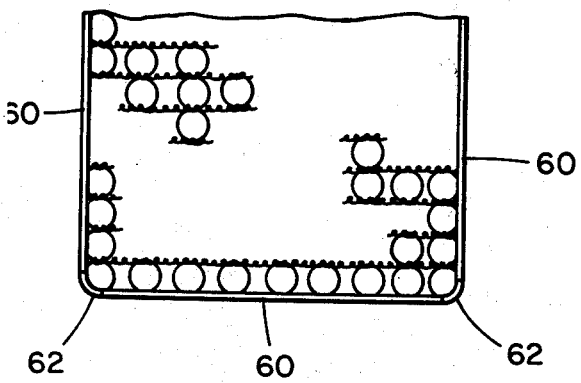
FIG. 13 is a partial plan view illustrating a further embodiment of the invention in which corner connector element joins straight sections of border frame.

Referring now to FIG. 13, an alternate construction is illustrated wherein only straight sections of the border frame are provided and corner connectors are employed for joining the straight sections to form the border frame. The straight sections are designated 60 while the corner connectors are designated 62. This construction has the advantage of eliminating the need for the special equipment capable of bending tubular metal while maintaining the channel in this proper dimension. The corner connectors 62 may conveniently be formed of plastic although metal connectors may be utilized, if desired.

Figure 14:
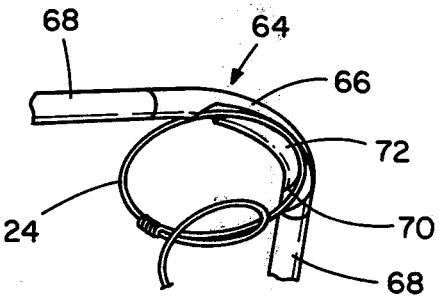
FIG. 14 is a bottom perspective view of a corner connector suitable for use in the FIG. 13 assembly.
Figure 15:
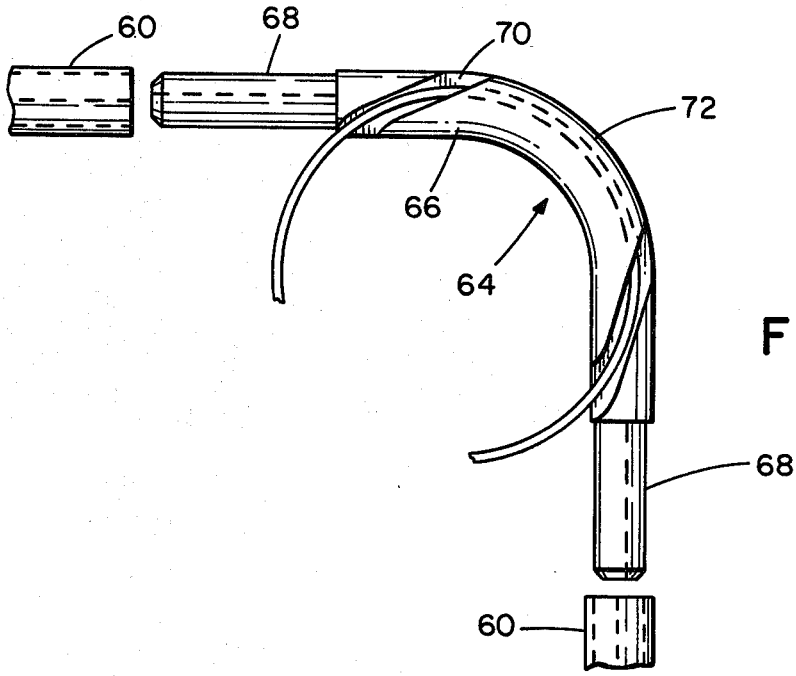
FIG. 15 is a plan view of the corner connector of FIG. 14.
Figure 16:
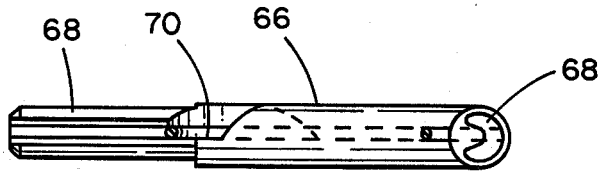
FIG. 16 is an end elevational view of the connector of FIG. 15.

Referring to FIGS. 14, 15 and 16, a corner connector according to a first embodiment is illustrated. The connector 64 includes an arcuate central portion 66 and end portions 68 provided on either side thereof. The central portion is provided with a recessed channel 70.

The channel is semicircular in nature and of an apparent diameter substantially identical to the diameter of the large coils 24 of the coil springs 12. The channel has its central portion provided along the outside contour of the central portion 66 while the ends of the channel 70 are provided along the bottom of the central portion. Thus, the recessed channel defines a retaining lip 72 which captures the large coil 24 to prevent the coil from slipping out of the channel. The corner connector end portions 68 are C-shaped in cross section and appear substantially identical to the connecting member 44 of FIG. 11 although of reduced length. The end portions are preferably integral with the curved central portion 66.

With reference to FIGS. 15 and 16, the method of assembly will be described. The tubular frame sections 60 are snapped into position on the spring assembly. The connector end portions 68 are then inserted into the tubular sections 60 thereby to join the tubular sections, one to the other. As indicated in FIG. 16, the end portions 68, by virtue of their C-shaped cross section, do not interfere with the gripping action of the lips. Finally, the large coil 24 of the corner spring is manually pulled towards the corner connector until the coil passes up and over the connector lip 72 and drops downwardly into the channel 70.

Figure 18A:
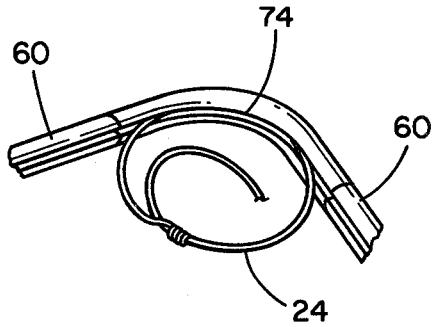
FIG. 18A is a perspective view of the corner connector illustrating the receipt of the spring into the connector channel.
Figure 17:
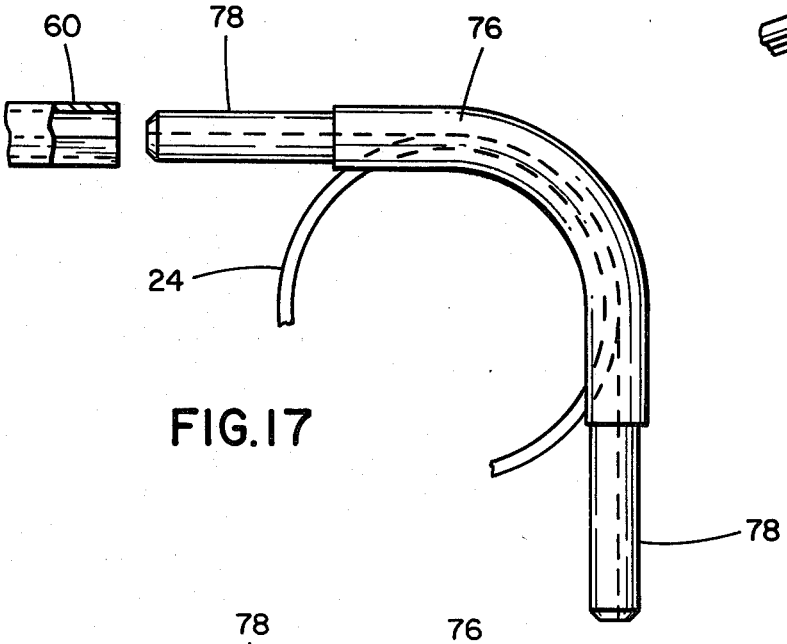
FIG. 17 is a plan view of a second embodiment of a corner connector for use with straight tubular sections.
Figure 18:
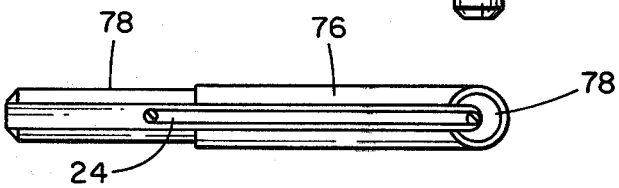
FIG. 18 is a side elevation of the FIG. 17 corner connector.

Referring now to FIGS. 17, 18 and 18A, a second embodiment of a corner connector is illustrated. As best seen in FIG. 18A, in this embodiment the corner connector is provided with a channel 74 of substantially the same dimension as the channel provided in the tubular members 60. Thus, the large coil 24 is received in the channel 74, as illustrated.

The corner member includes a central portion 76 and end portions 78 as with the FIG. 15 embodiment. These end portions are received in the tubular members 60 thereby to join the tubular members to form the complete frame. The large coil 24 is retained in the channel 74 by virtue of the dimensions of the channel. In the case where the corner member is manufactured from plastic the dimensions of the channel may be slightly smaller than the wire diameter used to form the large coil 24. In that case the inwardly extending ends of the channel will exert a gripping action on the coil 24 similar to the gripping action imparted by the lips of the tubular members.

Assembly of a border frame employing the corner connector of FIG. 17 is substantially identical with the assembly described in connection with FIG. 15. After the corner connector is inserted into the adjacent frame members 60 the coil 24 is snapped into the channel 74 thereby completing the assembly.

Referring now to FIGS. 21 through 26, a third embodiment of a corner connector is illustrated. In this embodiment a two piece corner connector is provided including an upper portion 80 and a lower portion 82. During assembly of the corner connector it is placed over the tubular frame sections 60 and snapped together. Before snapping the segments together the coil 24 is inserted in and captured by a locking means provided in the connector.

Figure 24:
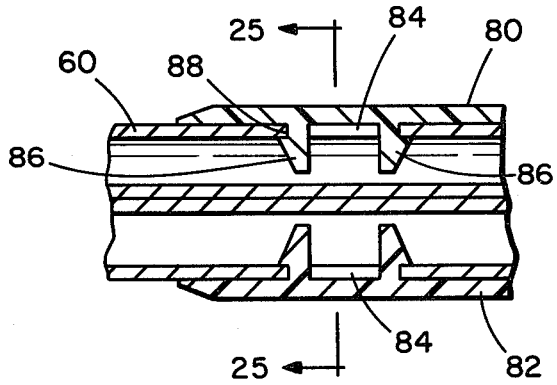
FIG. 24 is a sectional view along the lines 24—24 of FIG. 22.

This corner connector, unlike the previous two embodiments, does not fit within the tubular frame members which it connects. Rather, it snaps over the outside thereof and thus it is slightly larger than the tubular frame. In order to utilize the corner connector of FIG. 21, it is necessary that the tubular frame members 60 be provided with openings 84 in the top and bottom thereof (FIG. 24).

The upper and lower sections 80 and 82 of the corner connector are provided with locking tabs 86 adapted for insertion into the openings 84. The tabs 86 include a first inclined surface which abruptly terminates in a notched portion 88 dimensioned to receive the wall of the tubular member 60 therein. Thus, to attach the upper and lower portions of the corner connector to the tubular member it is only necessary to place the tabs over the openings 84 and press the tabs downwardly through the openings until the wall of the tubular section is captured in the notched portion 88.

Figure 22:
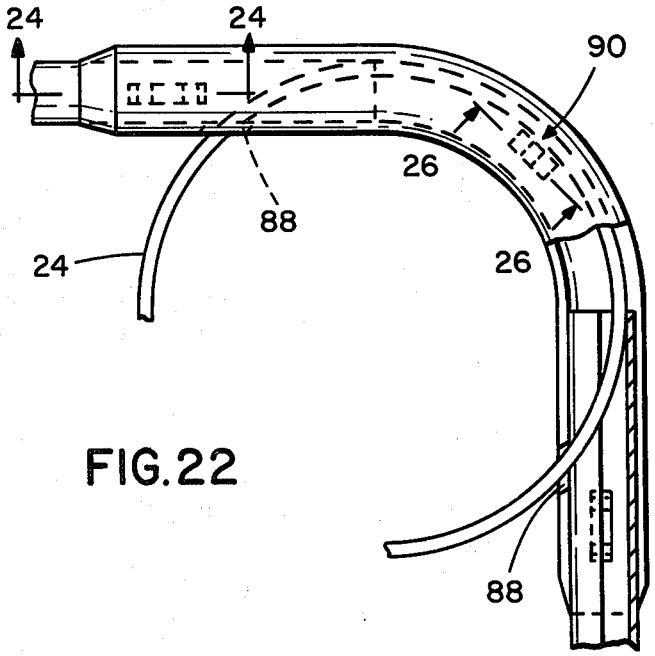
FIG. 22 is a plan view of the corner connector according to the third embodiment.
Figure 25:
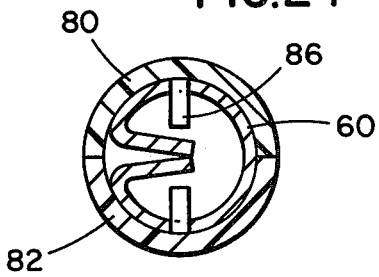
FIG. 25 is a cross sectional view along the lines 25—25 of FIG. 4.
Figure 23:
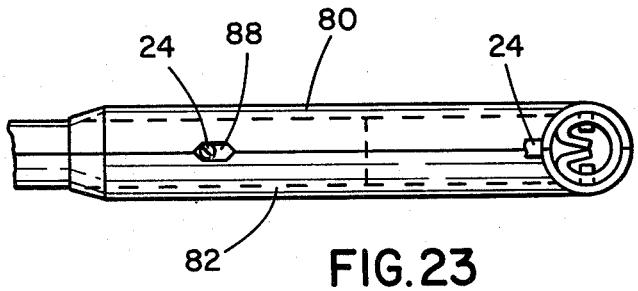
FIG. 23 is an end elevational view of the third embodiment.

As indicated in FIGS. 22 and 23, the two sections 80 and 82 define semicircular channel 88 passing through the corner connector and adapted to receive the large coil 24 of the spring 12. The channel 88 passes behind a locking mechanism 90 which serves to secure the upper portion 80 to the lower portion 82 during assembly. It will be apparent, with reference to FIG. 22, that once the portions 80 and 82 have been joined together the large coil 24 is secured in place within the connector.

Figure 26:
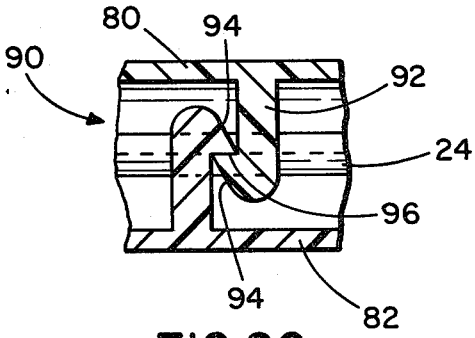
FIG. 26 is a sectional view along the lines 26—26 of FIG. 22.

With reference to FIG. 26, the locking mechanism 90 is illustrated in greater detail. The connector upper portion 80 is provided with a downwardly extending locking member 92 having a camming surface 94 and a locking surface 96. The connector lower portion 82 is provided with a reciprocal structure, as illustrated. Thus, as the two portions of the corner member are compressed together, the camming surfaces 94 engage to provide a sliding contact. When the cam surfaces terminate the locking surface 96 snap into contact with each other. This prevents separation of the upper and lower portions thereby locking the portions together with the large coil 24 captured therein.

Figure 21:
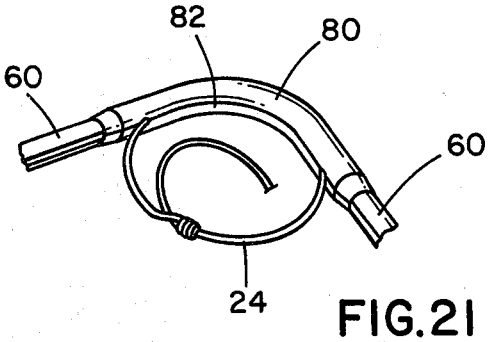
FIG. 21 is a perspective view of a third embodiment of a corner connector for use with straight tubular border frames.

The method of assembling the FIG. 21 corner connector can be varied according to the desire of the assembler. One technique is to snap the lower portion 82 onto the tubular members 60, locate the large coil 24 behind the locking member 90 and finally snap the upper portion 80 into place on the tubular members and simultaneously engaging the lock 90.

Up to this point the invention has been described in connection with inner spring assemblies suitable for mattresses and box spring border frames. The tubular border frame according to the invention also finds use in other environments and, indeed, has substantial advantage as a securing element in box spring constructions.

Figure 19:
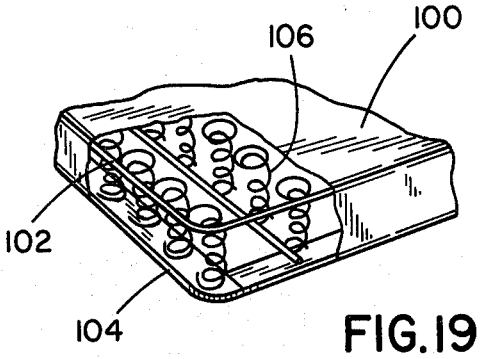
FIG. 19 is a perspective view of a box spring employing tubular sections to engage the ends of the coil springs.
Figure 20:
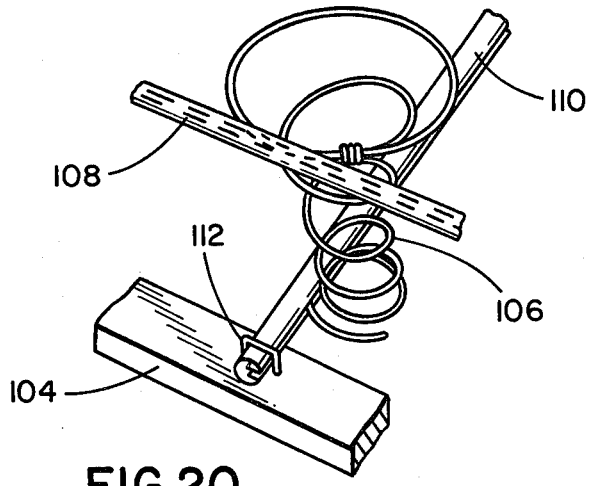
FIG. 20 is a fragmentary enlargement of the FIG. 19 view illustrating the assembly detail.

Referring to FIGS. 19 and 20, a box spring 100 is illustrated including a border frame 102 according to the invention surrounding a plurality of spring assemblies at their top. The bottom of the box spring consists of a wooden frame 104 with the large coil of the springs on the outside of the assembly connected directly thereto.

The interior springs 106 are secured in position by the use of tubular members identical in configuration to those illustrated in FIGS. 2 through 9. Thus, as illustrated in FIG. 20, interior spring 106 is secured at the top by a tubular member 108 and at the bottom by a tubular member 110. The bottom tubular member is secured to the wood frame 104 in any suitable manner as, for example, by the use of a brad 112. The upper tubular member 108 is secured to the border frame in any appropriate manner as, for example, by welding or by fasteners suitable for that purpose.

As will be readily appreciated from FIGS. 19 and 20, in the case of box spring construction wherein a wood frame 104 is provided it is possible to completely eliminate the need for helical wire binding of the coil spring assemblies. The tubular stock can be utilized exclusively for forming not only the border frame 102 but for joining the interior springs at their tops and bottoms as well. To facilitate assembly of a box spring utilizing this feature of the invention as assembly jig should be provided to receive the coil springs and hold them in their correct spaced relation while the tubular stock is attached to one end of the springs. Thereafter the assembly is inverted and the tubular stock and wood frame may be attached to the other end of the springs.

While I have shown and described embodiments of this invention in some detail, it will be understood that this description and illustrations are offered merely by way of example, and that the invention is to be limited in scope only by the appended claims.

I claim:

1. A border frame for attachment to coil inner spring assemblies comprising:

(a) a hollow elongated tubular member having open ends and of a length and configuration whereby one or more of said members will surround said inner spring assembly, said tubular member including means defining a longitudinally disposed opening into the interior of said member for receiving and securing therein a portion of selected ones of said inner spring assemblies at selected locations along said opening, (b) means for connecting the open ends of said tubular members to form said border frame, said receiving and securing means is a pair of opposed lips integral with said tubular member extending inwardly from the surface of said member to a point of engagement near the center of said member, said lips defining said opening therebetween and acting to receive and resiliently engage said spring assemblies.

2. A border frame according to claim 1 wherein said tubular member is metal.

3. A border frame according to claim 1 wherein said tubular member is a straight section and four such sections are employed to form said frame.

4. The border frame according to claim 1 wherein the tubular member has one or more straight sections and one or more curved sections.

5. The border frame according to claim 1 wherein said lips are periodically notched along their length dimension to define locking tabs which separate to permit entry of said spring assembly and then re-engage to lock said assembly within said tubular member.

6. The border frame according to claim 1 wherein said lips undulate in a sinusoidal manner, the crest of one lip nesting in the trough of the other lip.

7. The border frame according to claim 1 wherein said connecting means is a straight, elongated element, C-shaped in cross section, said element dimensioned to be snugly and completely received within the open ends of said tubular member thereby to engage and maintain said ends in end abutting relation.

8. The border frame according to claim 7 wherein said C-shaped element is configured to avoid interference with movement of said lips during insertion of said spring assemblies into said tubular member.

9. A border frame for attachment to coil inner spring assemblies comprising:

(a) a hollow elongated tubular member having open ends and of a length and configuration whereby one or more of said members will surround said inner spring assembly, said tubular member including means defining a longitudinally disposed opening into the interior of said member for receiving and securing therein a portion of selected ones of said inner spring assemblies at selected locations along said opening, (b) means for connecting the open ends of said tubular members to form said border frame, said connecting means is a straight, elongated element, C-shaped in cross section, said element dimensioned to be snugly and completely received within the open ends of said tubular member thereby to engage and maintain said ends in end abutting relation.

10. A border frame for attachment to coil inner spring assemblies comprising:

(a) a hollow elongated tubular member having open ends and of a length and configuration whereby one or more of said members will surround said inner spring assembly, said tubular member including means defining a longitudinally disposed opening into the interior of said member for receiving and securing therein a portion of selected ones of said inner spring assemblies at selected locations along said opening, (b) means for connecting the open ends of said tubular members to form said border frame, said connecting means being a corner connector and including:

a central curved portion, straight end portions on either side of said central portion adapted to be snugly received within the ends of said tubular members, said central portion including inwardly directed lips formed as part of said central portion, said lips defining a channel dimensioned to receive and retain a selected spring assembly.

11. A border frame for attachment to coil inner spring assemblies comprising:

(a) a hollow elongated tubular member having open ends and of a length and configuration whereby one or more of said members will surround said inner spring assembly, said tubular member including means defining a longitudinally disposed opening into the interior of said member for receiving and securing therein a portion of selected ones of said inner spring assemblies at selected locations along said opening, (b) means for connecting the open ends of said tubular members to form said border frame, said connecting means being a corner connector of two piece construction including:

an upper portion, a lower portion, means for locking said portions to each other and to said tubular members, means for securing a selected one of said coil spring assemblies to said connector.

12. A border frame according to claim 11 wherein said locking means include:

(a) locking tabs, said tubular members having openings adapted to receive said tabs therein thereby to secure the portions to said tubular members, (b) reciprocal locking members provided on said upper and lower portions adapted to interengage to secure the portions together.

13. A border frame according to claim 12 wherein said securing means includes an internal channel defined by the walls of said portions, said channel located to position said coil spring behind said locking members thereby to retain said spring in said channel.

14. An elongated tubular member for securing a plurality of coil springs into a spring assembly comprising:

a hollow tubular member open at both ends thereof, said member having a longitudinally disposed opening into the hollow interior of said member defined by a pair of opposed lips extending from the surface of said member to a point near the center of said member, said lips receiving and securing said springs at selected locations along said opening.

15. The border frame according to claim 14 wherein said lips are periodically notched along their length dimension to define locking tabs which separate to permit entry of said springs and then re-engage to lock said springs within said tubular member.

* * * * *